US006675776B2

(12) United States Patent
Gibson et al.

(10) Patent No.: US 6,675,776 B2
(45) Date of Patent: Jan. 13, 2004

(54) ELECTRO-HYDRAULIC ACTUATOR FOR A HYDRAULIC PUMP

(75) Inventors: Dennis H. Gibson, Chillicothe, IL (US); Ryan P. Michels, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 95 days.

(21) Appl. No.: 10/020,620

(22) Filed: Dec. 14, 2001

(65) Prior Publication Data

US 2003/0111048 A1 Jun. 19, 2003

(51) Int. Cl.[7] ..... F02M 37/04
(52) U.S. Cl. ..... 123/495
(58) Field of Search ..... 123/946, 510, 123/514, 497, 499, 495; 417/269, 270, 273

(56) References Cited

U.S. PATENT DOCUMENTS 5,042,445 A * 8/1991 Peters et al. ..... 123/446
5,167,493 A * 12/1992 Kobari ..... 417/273
5,740,782 A * 4/1998 Lowi, Jr. ..... 123/446
6,035,828 A 3/2000 Anderson et al.
6,216,670 B1 * 4/2001 Anderson et al. ..... 123/446
6,227,167 B1 5/2001 Smith et al.
6,267,561 B1 7/2001 Sommars

* cited by examiner

*Primary Examiner*—Mahmoud Gimie
(74) *Attorney, Agent, or Firm*—Liell & McNeil

(57) ABSTRACT

A hydraulically-actuated system includes a fix displacement variable delivery pump with a plurality of parallel disposed pistons that reciprocate in a pump housing the defines a high pressure portion and a low pressure area. A control device is attached to the pump housing and moveable between a first position in which the pistons displace fluid into the high pressure portion and a second position in which pistons spill fluid back to the low pressure area. The control device includes an electrically driven linear motion device, a linkage and a plurality of sleeves, one being disposed on each piston. Linear movement of the control device in turn causes linear movement of the sleeves. The position of the sleeves in turn determines the amount of output of the pump.

20 Claims, 3 Drawing Sheets

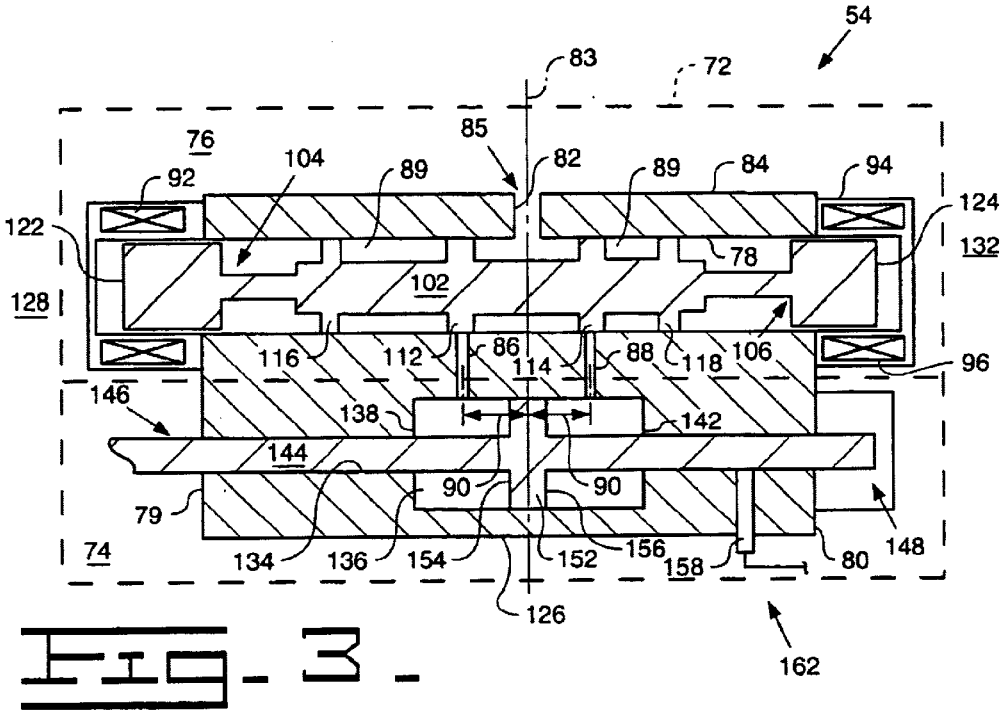
Fig. 3.
Fig. 4.
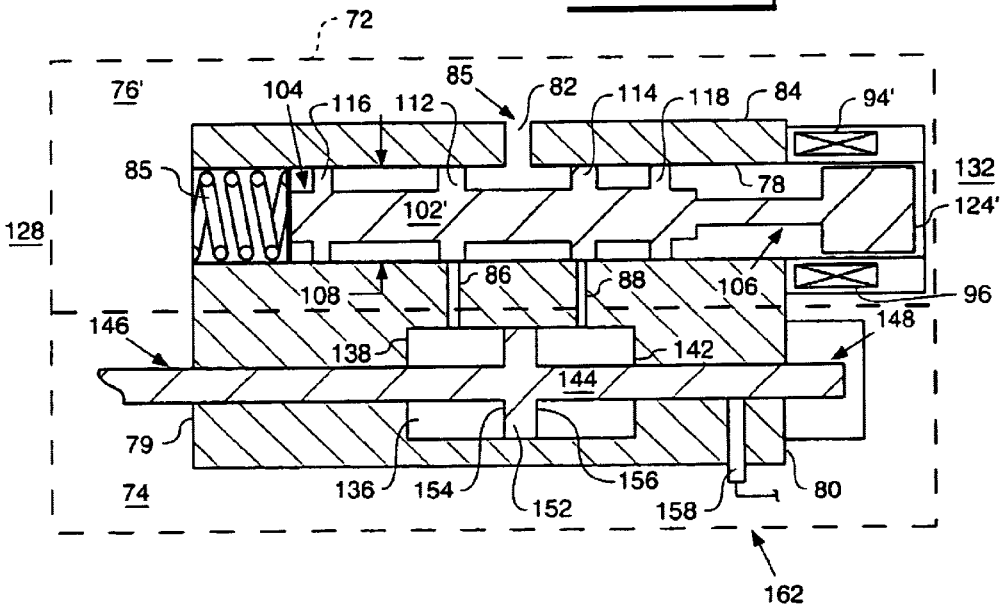

ELECTRO-HYDRAULIC ACTUATOR FOR A HYDRAULIC PUMP

TECHNICAL FIELD

The present invention relates generally to hydraulically-actuated system, and more particularly to a electro-hydraulic closed loop actuator of a variable delivery fixed displacement pump.

BACKGROUND ART

U.S. Pat. No. 6,035,828 to Anderson et al. describes a variable delivery actuating fluid pump for a hydraulically-actuated fuel injection system. In this system, a high pressure rail supplies pressurized lubricating oil to a plurality of hydraulically-actuated fuel injectors mounted in a diesel engine. The high pressure rail is pressurized by a variable delivery fixed displacement type pump that is driven directly by the engine. Pump pressure control is provided by hydraulically varying the high pressure output of the pump. This is accomplished by providing a piston arrangement in the pump that incorporates a moveable sleeve on the outside of the pistons. Depending upon the position of the sleeve, a spill port on the piston is opened or closed. When the spill port is opened, the fluid is spilled back into the low pressure side of the pump, instead of being pushed into the high pressure rail. The position of the sleeve is maintained by a hydraulic actuator. Fluid in the hydraulic actuator moves an actuator shaft, which in turn moves the sleeve.

While the Anderson et al. hydraulically-actuated system using a variable delivery pump performs better than previous systems there remains room for improvement. The complicated mechanical structure of the pump and hydraulic actuator provides potential leak paths for hydraulic fluid. Also, because the viscosity of lubricating oil varies due to temperature, control of the pump may be sluggish when the oil is of an extremely cold temperature.

The present invention is directed to overcoming problems associated with, and improving upon, hydraulically-actuated systems of the prior art.

SUMMARY OF THE INVENTION

In one aspect of the invention a variable delivery fixed displacement pump is provided. The pump includes an actuator having an actuator bore, a first directional port and a second directional port. An actuator shaft is disposed within the bore and moveable in a first direction and a second direction in response to receiving fluid from the first or second directional port. The actuator shaft is adapted to vary the amount of fluid output from the pump. A valve having a spool, a first solenoid coil and a second solenoid coil directs fluid to one of the first or second directional ports in response to a signal from a controller.

In another aspect of the invention a fluid delivery system is provided. The fluid delivery system includes a controller, a pump having a high pressure outlet and an actuator having a position sensor. A pressure sensor is provided to sense the pressure in a high pressure rail is included. A valve between the high pressure outlet and one of the first or second directional ports, directs fluid to he actuator.

In yet another aspect of the present invention a method for controlling a variable delivery fixed displacement is provided. The method includes delivering a flow to one of a first or second directional port. An actuator shaft is moved in one of a first direction and a second direction in response to delivering flow to one of the first and second directional flows. Fluid flow from the pump is varied depending upon position of the actuator shaft.

BRIEF DESCRIPTION OF THE DRAWINGS

FIG. 3 is a sectioned side diagrammatic view of an electro-hydraulic actuator according to one of the present invention.

FIG. 4 is a is a section side diagrammatic view of an electro-hydraulic actuator according to another aspect of the present invention.

DETAILED DESCRIPTION

Figure 1:
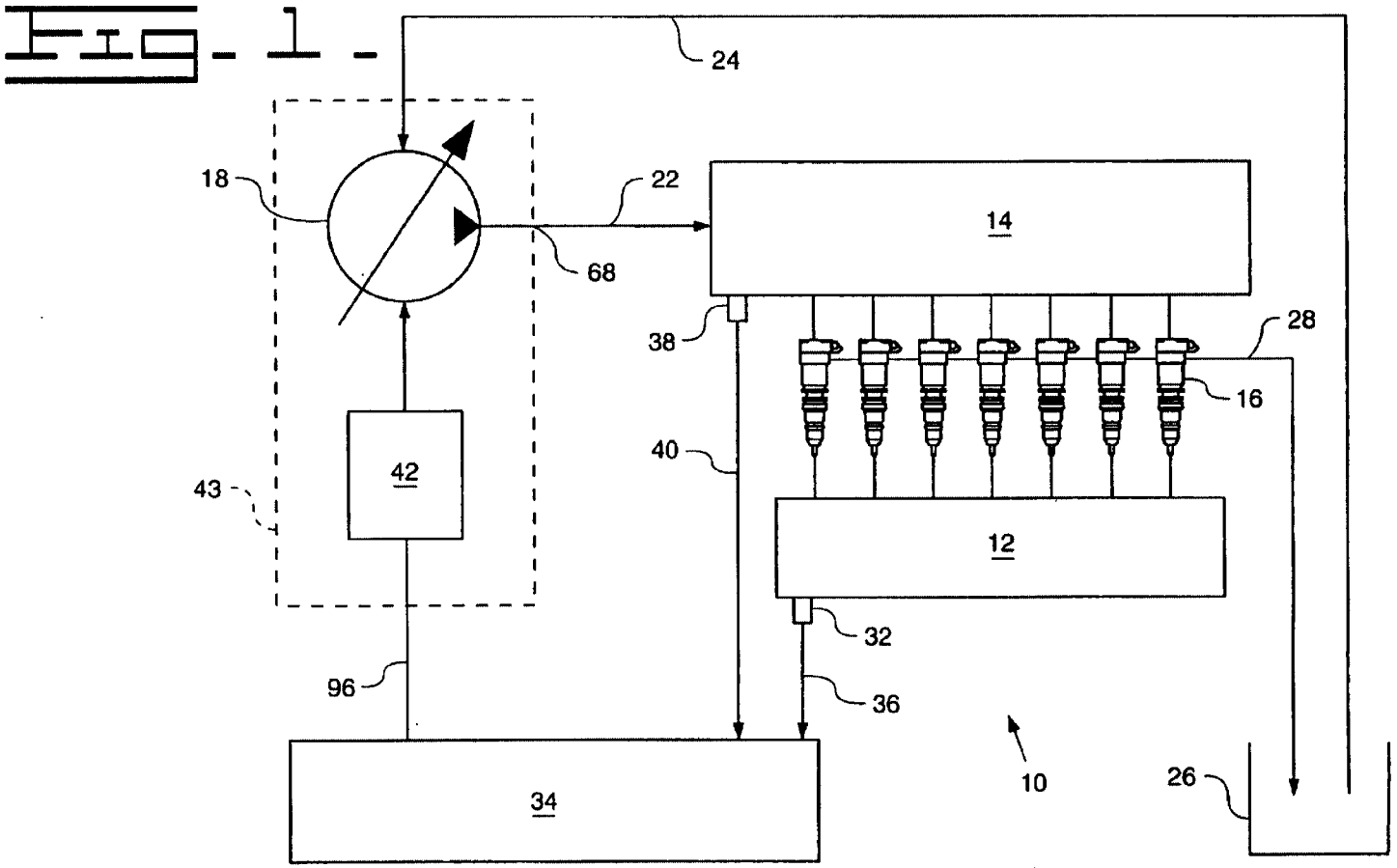
FIG. 1 is a schematic illustration of a hydraulically-actuated system according to the present invention.

Referring now to FIG. 1, a hydraulically actuated system 10 is attached to an internal combustion engine 12. The hydraulically actuated system 10 includes a high pressure rail 14 that supplies actuation fluid to a plurality of hydraulically-actuated devices, such as hydraulically-actuated fuel injectors 16. Those skilled in the art will appreciate that other hydraulically-actuated devices, such as actuators for gas exchange valves for exhaust brakes, could be substituted for the fuel injectors 16 illustrated in the example embodiment. The high pressure rail 14 is pressurized by a variable delivery fixed displacement pump 18, via a high pressure supply conduit 22. The pump 18 draws actuation fluid along a low pressure supply conduit 24 from a source of low pressure fluid, which is preferably the engine's lubricating oil sump 26. Although other available liquids could be used, the present invention preferably utilizes engine lubricating oil as its hydraulic medium. After the high pressure fluid does work in the individual fuel injectors 16, the actuating fluid is returned to sump 26 via a drain passage 28. p As is well known in the art, a desired pressure in high pressure rail 14 is generally a function of the engines 12 operating condition. For instance, at high speeds and loads, the rail pressure is generally desired to be significantly higher than the desired rail pressure when the engine 12 is operating at an idle condition. An operating condition sensor 32 is attached to engine 12, the sensor 32 provides an electronic control module 34 with sensor data, which includes engine speed and load conditions, via a first communication line 36. In addition, a pressure sensor 38 periodically provides the electronic control module 34 with the measured fluid pressure in the high pressure rail 14 via a second communication line 40. The electronic control module 34 compares the desired rail pressure with the actual rail pressure, as provided by the pressure sensor 38. The electronic control module 34 sends a control signal to a control device 42, which in turn adjusts the amount of fluid output from the pump 18.

Figure 2:
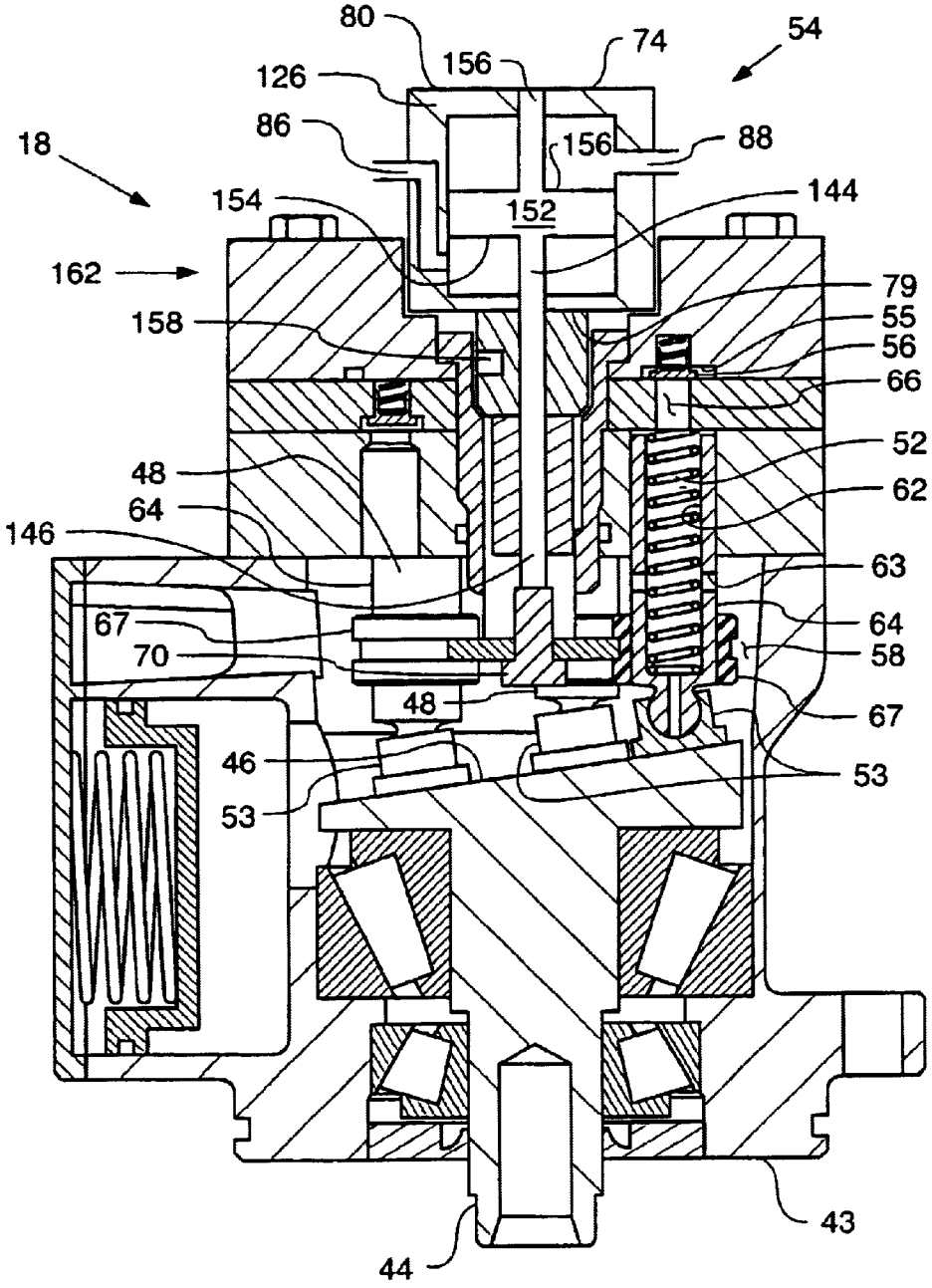
FIG. 2 is a sectioned side diagrammatic view of a variable delivery fixed displacement pump of the present invention.

Referring now to FIG. 2, various components of the pump 16 are contained within a pump housing 43. Pump 18 includes a rotating pump shaft 44 that is coupled directly to the engine 12, such that the rotation rate of the pump shaft 44 is directly proportional to rotation of the crank shaft (not shown) of the engine 12. A fixed angle swash plate 46 is attached to the pump shaft 44. The rotation of swash plate 46 causes the plurality of parallel disposed pistons 48 to reciprocate from left to right. In this example, the pump 18 includes five pistons 48 that are continuously urged toward the swash plate 46 by individual return springs 52. Each of the return springs 52. maintains a shoe 53, which is attached to one end of each piston 48, in contact with the swash plate 46 in a conventional manner. Because the swash plate 46 has a fixed angle, the pistons 48 reciprocate through a fixed reciprocation distance with each rotation of the pump shaft 44. Thus, the pump 18 can be thought of as a fixed displacement pump 18. However the control device, which includes an electro-hydraulic actuator 54, determines if the fluid displaced by each piston 48 is pushed into a high pressure outlet 68 past a check valve 56 or spilled back into a low pressure portion 58 of the pump 18.

Each piston 48 includes an internal passage 62 that extends axially within the piston 48. A spill port 63 extends radially outward from the internal passage 62 to an outer surface 64. The outer surface 64 is disposed within the low pressure portion 58 of the pump 18. Pressure within a pumping chamber 66, under each piston 48, can only build when the spill port 63 is covered by a sleeve 67. The sleeve 67 is adapted to slide axially on the outer surface 64 of the piston 48. When the sleeve 67 covers the spill port 63, fluid displaced by the piston 48 is pushed past the check valve 56, into the high pressure portion 55, and eventually out of a high pressure outlet 68 to the high pressure rail 14. When the pistons 48 are undergoing the retracting portion of their stroke due to the action of the return spring 52, low pressure fluid is drawn into pumping chamber 66 from the low pressure portion 58. The sleeves 67 are axially fixed to a linkage 70 that is further fixed to the electro-hydraulic actuator 54. The electro-hydraulic actuator 54 may be disposed within the pump housing 43 or located externally.

Referring now to FIGS. 3 and 4, the electro-hydraulic actuator 54 of the present invention is illustrated. The electro-hydraulic actuator 54 includes a body 72, an actuator portion 74 and a spool valve portion 76. In this embodiment the actuator portion 74 and spool valve portion 76 are disposed in one body 72. It should be realized that the actuator portion 74 could be disposed in a separately than that of the spool valve portion 76 without deviating from the intended scope of the invention.

The spool valve portion 76 of the body includes a bore 78 extending from a first side 79 to a second side 80. A high pressure inlet port 82 extends from the bore 78 to an outer body surface 84. A high pressure fluid source, preferably the high pressure rail, is connected to the inlet port 82. The inlet port 82 is located approximately at a midpoint 83 between the first end 128 and the second end 132. A first directional port 86 and a second directional port 88 extend from the bore 78 to the actuator portion 74 of the body 72. The directional ports 86,88 are spaced at an predetermined distance 90 to the left or right of the midpoint 83. A left solenoid coil 92 and a right solenoid coil 94 are adapted to be received by the body 72 at each end of the bore 78. The left coil 92 and the right coil 94 are connected to the electronic control module 34 via a signal line 96. A valve spool 102 having a first end 104, a second end 106 and a predetermined diameter is slideably positioned within the bore 78. The valve spool 102 includes a first directional land 112 and a second directional land 114 that extend radially outward from the spool 102. The first and second directional lands 112, 114 have a diameter that is slightly smaller than that of the bore 78, permitting sliding movement within the bore 78. The first directional land 112 and second directional land 114 are disposed a distance left or right of a midpoint of the spool 102 equal to the predetermined distance 90, so that when the spool 102 is centered in the bore 78 the first and second directional ports 86, 88 are closed. A first drain land 116 and a second drain land 118 are disposed to the left and right, respectively, of the first and second directional lands 112, 114. The first and second drain lands 116, 118 are also of a diameter that is slight smaller than that of the bore 78. A left armature 122 and a right armature 124 are disposed toward the left end and the right end of the spool 102. The left and right armatures 122, 124 are slidingly positioned within the left and right solenoid coils 92, 94. When the left coil 92 is energized the spool 102 moves left of the midpoint 83, permitting flow of high pressure fluid from the inlet port 82, through the bore 78 to the left directional port 86. Conversely, when the right coil 94 is energized the spool 102 moves toward the right permitting high pressure fluid to flow from the inlet port 82 through to the right directional port 88. Energizing both the left and right coils 92, 94 causes the spool 78 to center and blocking fluid flow to either of the left or right directional ports 86, 88.

The actuator portion 74 includes an actuator body 126 having a first side 79 and a second side 80. A shaft bore 134 having a piston cavity 136 extends from the first side 79, through the actuator body 126 to the second side 80. The piston cavity 136 includes a first end 138 and a second end 142. The first directional port 86, connects the piston cavity near first end 138 and the second directional port 88, connects the piston cavity 136 near the second end 142. An actuator shaft 144 having a first end 146 and second end 148 is slidingly positioned in the shaft bore 134. An actuator piston 152 having a left face 154 and a right face 156 extends radially outward from the actuator shaft 144, at a position within the cavity 136. The actuator piston 152 is positioned in the cavity 136 between the first and second directional ports 86, 88. Fluid flow from the first directional port 86 moves the actuator shaft 144 and piston 152 toward the right. Movement of the piston 152 toward the right, causes fluid on the right side of the piston to be forced into the right directional port 88 and flow back through the spool valve portion 76 into the low pressure drain 89. The linkage 70 mechanically couples the actuator shaft 144 to the control device 42 of the pump 18.

A position sensor 158 is operatively positioned within the actuator portion 74 to sense the position of the actuator shaft 144 relative to the actuator body 126. The position sensor 158 is of conventional construction and will not be discussed in detail. The position sensor 158 may alternatively be positioned within the pump housing 42 to sense position of the control valve. The position sensor 158 provides an electronic signal to the electronic control module 34 related to the axial position of the control device 42 or actuator shaft 144. The position sensor 158 sends the position signal via a third communication line 162. The electronic control module 34 stores data related to the position of the control device 42 and processes the data to determine a need to modify control signals to the control device 42.

Referring now to FIG. 4, another embodiment of the present invention is illustrated. Similar to FIG. 3, the electro-hydraulic actuator 52 of the present invention includes a actuator portion 74' and a spool valve portion 76'. The spool valve portion 76' includes only a right solenoid coil 94', and the spool 102' includes only one right armature 124'. The first end 104 of the spool 102' is biased toward the right by a spring 85. The electronic control module 34 energizes the right coil 94' to move the spool 102' toward the spring 85.

INDUSTRIAL APPLICABILITY

In operation an internal combustion engine 12 drives a fixed displacement variable delivery pump 18. The pump 18 draws fluid from a lubricating oil sump 26 into a low pressure portion 58 of the pump 18. Rotation of a plurality of pistons 48 around a shaft 44, causes the pistons 48 to move in an axial direction. Movement of the pistons 48 is caused by a fixed angle swash plate 46. The pistons 48 move between a first position, and a second position nearest a high pressure portion 55. In the first position fluid flows from the low pressure portion 58 of the pump 18 into the piston 48. As the piston 48 moves toward the second position, fluid is pushed into the high pressure portion 55 of the pump 18. A control device 42 controls the amount of fluid output from the piston 48 to the high pressure portion 55 of the pump 18. An electronic control module 34 sends a signal to the electro-hydraulic actuator 54 via a signal line 96.

The electronic control module 34 receives a signal from a pressure sensor 38 located in the high pressure common rail 14 via a communication line 40. Additionally, the electronic control module 34 receives a signal from an operating condition sensor 32 on the internal combustion engine 12 via communication line 36. The operating condition sensor 32 signals the electronic control module 32 the status of a plurality of operating parameters of the internal combustion engine 12. The position sensor 158 also sends data related to the position of the actuator shaft 144 and/or the control device 42 to the electronic control module 34. Based on the need to alter fluid pressure in the high pressure rail 14 the electronic control module 32 commands movement of the electro-hydraulic actuator 54.

The present invention decreases the complexity of prior art hydraulically-actuated systems by providing a signal electro-hydraulic actuator 54 for controlling pressure in the high pressure rail 14. Responses time of the electro-hydraulic actuator 54 is not as greatly effected by the temperature of oil as with prior systems. Faster pump 18 control during lower temperature operation improves emissions output of the internal combustion engine 12. Additionally, the elimination of a number of pump 18 components and fluid seals within the pump 18 reduces the possibility of oil leakage from the pump 18.

The above description is intended for illustrative purposes only, and is not intended to limit the scope of the present invention in any way. For instance, other types of actuators could be substituted for the example illustrated actuator without departing from the intended scope of the present invention. Thus, those skilled in the art will appreciate that various modifications can be made to the illustrated embodiment without departing from the spirit and scope of the present invention, which is defined in terms of the claims set forth below.

What is claimed is:

1. A variable delivery fixed displacement pump comprising:

an actuator having an actuator bore, a first directional port, a second directional port and an actuator shaft disposed within said actuator bore, said actuator shaft being moveable in a first direction in response to fluid flow being received at said first directional port and a second direction, in response to receiving fluid flow at said second directional port;

said actuator shaft being connected to a sleeve to vary a fluid flow from said pump in response to receiving fluid flow at one of said first and second directional port; and a valve having a spool, at least one solenoid coil, said spool being moveable to direct said fluid flow to one of said first directional port and said second directional port, in response to an electrical current from a controller being applied to said at least one solenoid coil.

2. A variable delivery fixed displacement pump comprising:

an actuator having a having an actuator bore, a first directional port, a second directional port and an actuator shaft disposed within said actuator bore, said actuator shaft being moveable in a first direction in response to fluid flow being received at said first directional port and a second direction, in response to receiving fluid flow at said second directional port;

said actuator shaft being connected to vary a fluid flow from said pump in response to receiving fluid flow at one of said first and second directional port;

a valve having a spool, a first solenoid coil and a second solenoid coil, said spool being moveable to direct said fluid pressure to one of said first directional port and said second directional port, in response to an electrical current from a controller being applied to one of said first solenoid coil and said second solenoid coil; and a position sensor, said position sensor being adapted to provide a signal relative to the position of said actuator shaft.

3. The pump of claim 1 wherein said controller is an electronic control module.

4. The pump of claim 1 wherein said valve includes a single solenoid coil and a spring, said spool being moveable in a first direction in response to said single solenoid coil being energized and said spool being moveable in said second direction in response to said spring when said single solenoid coil being de-energized.

5. A fluid delivery system comprising:

a controller;

a pump having a high pressure outlet, said high pressure outlet delivering a high pressure fluid;

a high pressure rail in fluid communication with said high pressure outlet;

an actuator having a shaft, said shaft being moveable in a first direction and a second direction, said second direction being opposite of said first direction, said direction of movement being related to a high pressure fluid being directed to one of a first directional port and a second directional port;

a position sensor being connected to sense a position of said actuator shaft and delivering a responsive shaft position signal;

a valve between the high pressure fluid outlet and said actuator, said valve directing said high pressure fluid to a one of said first directional port and second directional port; and a pressure sensor connected to sense fluid pressure within said high pressure rail and deliver a responsive pressure signal, said controller being connected to said position sensor and said pressure sensor, wherein said controller alters a control signal in response to one of said position signal and said pressure signal.

6. The fluid delivery system of claim 5 wherein said controller is an electronic control module.

7. The fluid delivery system of claim 5 including a fuel injector in fluid communication with said high pressure rail.

8. The fluid delivery system of claim 5 wherein said valve is a spool valve, having a spool being moveable between a first position and a second position, wherein said spool being in said first position directs fluid pressure to said first directional port and said spool being in said second position directs high pressure fluid to said second directional port.

9. The fluid delivery system of claim 8, said spool valve including a pair of solenoid coils, wherein energizing one of said pair of solenoid coils acts upon said spool to cause movement between said first position and said second position.

10. The fluid delivery system of claim 9, said spool valve including a solenoid coil and a spring, wherein energizing said solenoid coil acts to cause movement of said spool in a first direction, and said coil being de-energized spring causes movement of said spool in said second direction.

11. A method for controlling a variable delivery fixed displacement pump comprising the steps of:

delivering a flow of pressurized fluid to one of a first directional port and a second directional port;

moving an actuator shaft in one of a first direction and a second direction in response to receiving said flow of pressurized fluid at said first directional port or said second directional port; and varying an amount of fluid flow delivered from said pump in response to the position of said actuator shaft.

12. The method of claim 11 including the step of having an electronic control module adapted to generate said control signal.

13. The method of claim 11 including the step of said actuator having a position sensor for sending a signal to said electronic control module, said signal being related to the position of said actuator shaft.

14. The method of claim 11 including the step of energizing a first solenoid coil, said first solenoid coil being energized and causing said actuator shaft to move toward said first position.

15. The method of claim 11 including the step of energizing a second solenoid coil, said second solenoid coil being energized and causing said actuator shaft to move toward said second position.

16. A pump comprising:

a pump housing;

at least one pump piston operable to reciprocate in said pump housing;

a sleeve surrounding each said at least one pump piston; and said sleeve being axially fixed via a linkage to move with an actuator piston of an electro-hydraulic actuator.

17. The pump of claim 16 wherein said actuator piston has opposing hydraulic faces.

18. The pump of claim 16 including a fixed angle swash plate and a plurality of pump pistons.

19. The pump of claim 16 including a position sensor operably positioned in said pump housing to generate a signal indicative of a position of said sleeve.

20. The pump of claim 16 wherein said electro-hydraulic actuator includes at least one solenoid operatively coupled to a spool valve member.

* * * * *